United States Patent [19]

Stone

[11] 4,255,917

[45] Mar. 17, 1981

[54] STRING PACKAGING MACHINE AND APPARATUS

[76] Inventor: Walter N. Stone, 18 Rundelane, Bloomfield, Conn. 06002

[21] Appl. No.: 77,852

[22] Filed: Sep. 21, 1979

[51] Int. Cl.[3] ..... B65B 63/04

[52] U.S. Cl. ..... 53/430; 53/116; 242/47

[58] Field of Search ..... 53/409, 430, 118, 116; 242/47, 53, 83

[56] References Cited

U.S. PATENT DOCUMENTS

| | | | |
|---|---|---|---|
| 3,490,192 | 1/1970 | Regan | 53/430 |
| 3,618,282 | 11/1971 | Hagel et al. | 53/430 |

*Primary Examiner*—Travis S. McGehee

[57] ABSTRACT

Filamentary members, music strings for example, are automatically coiled and the coils captured on a sheet of packaging material by feeding the members into an annular groove against a surface of a sheet of heat sealable material and subsequently shearing tabs from the sheet of material and folding the tabs over the coiled member. Coiling of the members is accomplished by feeding a first end of each member, preferably with the aid of pneumatic pressure, into the annular groove, capturing the end in the groove and thereafter causing relative rotation between the groove and member to draw the member into the groove.

26 Claims, 4 Drawing Figures

13
100
98
94
96
102
90
92
80
82
12
M
50
52
70
76
72
74
84
104
54
49
64
44
60
66
38
68
58
44A
42
40
2
2
86
16
62
20
56
18
14
26
28
22
30
24
10

STRING PACKAGING MACHINE AND APPARATUS

BACKGROUND OF THE INVENTION (1) Field of the Invention

The present invention relates to the packaging of lengths of resilient material and particularly filamentary material. More specifically, this invention is directed to apparatus for coiling elongated resilient elements and thereafter retaining such elements in coiled form. Accordingly, the general objects of the present invention are to provide novel and improved methods and apparatus of such character.

(2) Description of the Prior Art

While not limited thereto in its utility, the present invention is particularly well suited for use in the packaging of strings for musical instruments. The discussion below will, accordingly, be primarily in terms of the solution of problems which, while not unique thereto, are particularly important to the packaging of such music strings.

Numerous apparatus and techniques for arranging filamentary material in an annular pack by forming it into a succession of superimposed generally circular loops have, over the years, been proposed and in some cases implemented. These prior techniques and apparatus have shared common deficiencies. With particular regard to those prior techniques and apparatus suitable for use in the handling of finished products having a high degree of resiliency, music strings for example, the principal deficiency has been the requirement for a significant amount of manual labor. Thus, in spite of numerous attempts to automate, the prevalent practice in the music string industry today is to coil the product by hand, manually "tuck" the ends around the formed coil so that the coil shape will be retained and thereafter either insert the coiled product by hand into a package or into a machine which subsequently accomplishes the final packaging. The cost of this hand labor may amount to as much as 40% of the total cost of the finished product. Further, the hand coiling of the music string product may result in excessive deformation which permanently damages the string. Additionally, points of direct finger contact with the product are potential sites of corrosion.

SUMMARY OF THE INVENTION

The present invention overcomes the above briefly discussed and other deficiencies and disadvantages of the prior art by providing a novel and improved technique and apparatus for automatically coiling and prepackaging and/or packaging resilient filamentary material which is manufactured in straight form. The method and apparatus of the present invention eliminate the damage due to execessive deformation of the product, which is inherent in manual coiling operations, and minimize handling of the product, to thereby minimize the possibility of chemical damage such as that attributable to corrosion.

Apparatus in accordance with a preferred embodiment of the present invention is characterized by a conduit which receives the product, for example a music string, to be packaged. This conduit, at the discharge end, communicates with a coiling annulus which, in part, is defined by a planar support surface. Means are provided which permits a sheet of heat sealable packaging material to be positioned on the support surface in registration with the coiling annulus. The leading end of the music string is directed, preferrably pneumatically, into the coiling annulus where it is engaged in a capture slot. The remainder of the music string, or other product, is then drawn from the conduit into the coiling annulus by causing relative rotation between the capture slot and the conduit. A plurality of knives are positioned in slots in coiling annulus support surface and, when the coiling step is completed, the knives are rotated to shear tabs out of the sheet of packaging material. These tabs are folded over the coiled product by the knives and into contact with the surface of the sheet to which they instantly adhere thereby retaining the product in the coiled form.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

Figure 1:
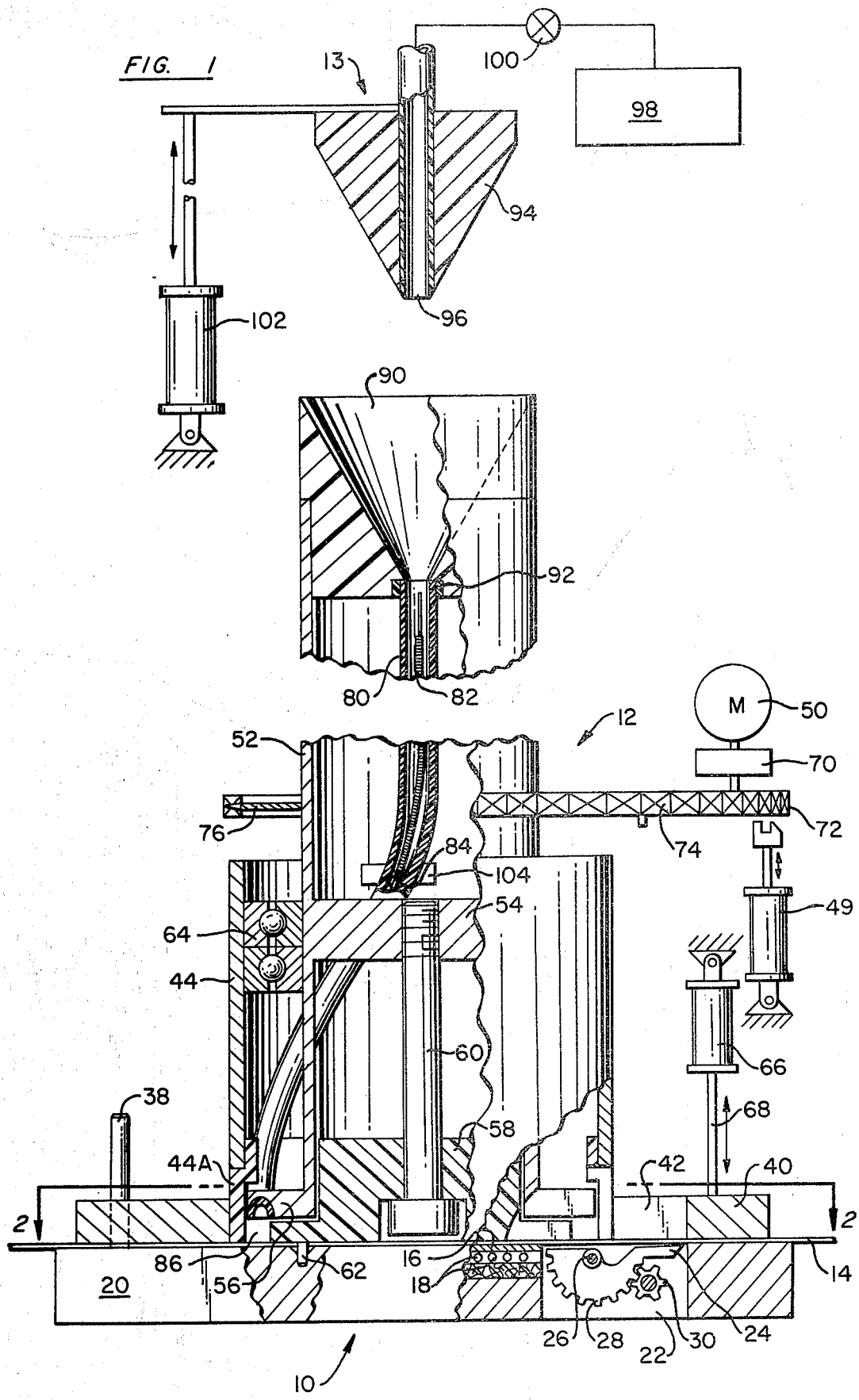
FIG. 1 is a schematic side elevation view, partly in section, of apparatus in accordance with a first embodiment of the present invention.
Figure 2:
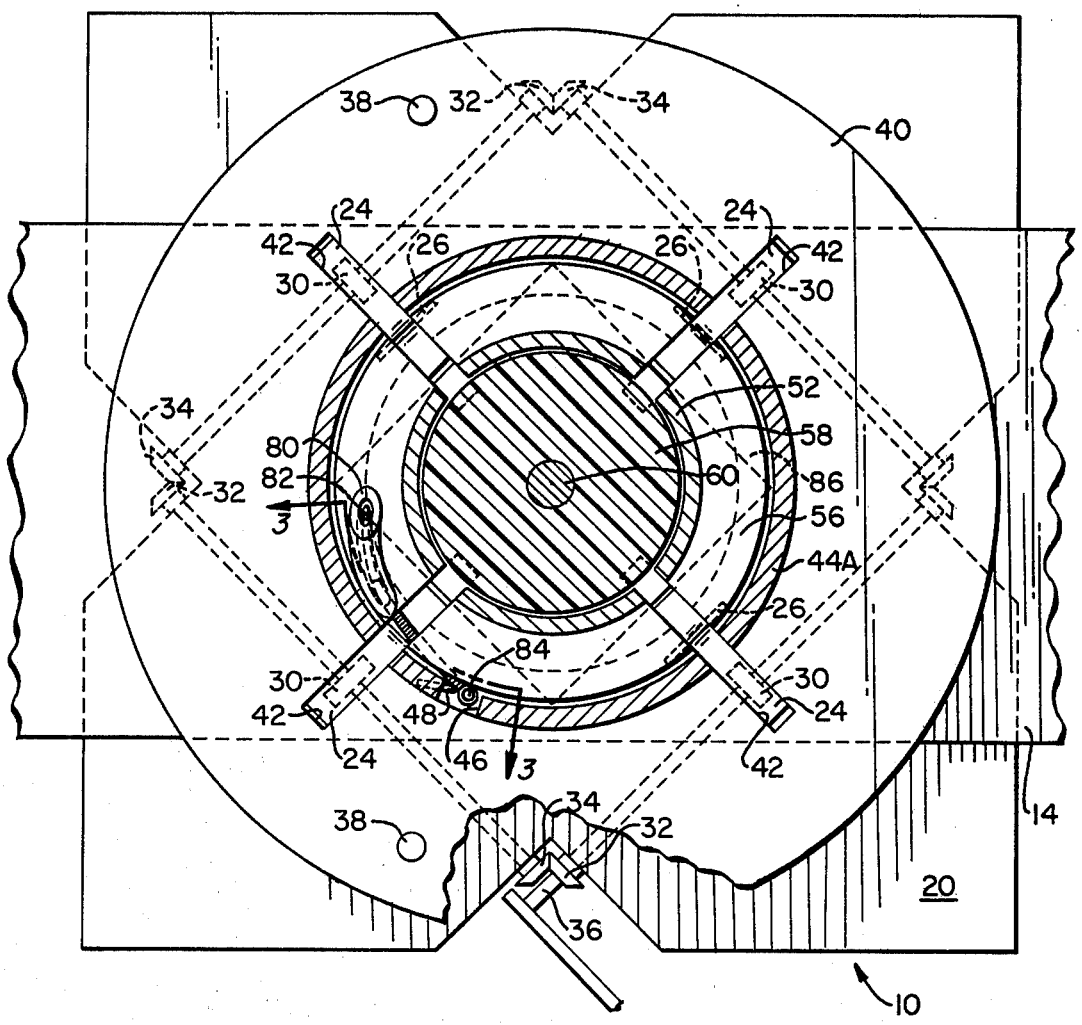
FIG. 2 is a plan view taken along the lines 2—2 of FIG. 1.
Figure 3:
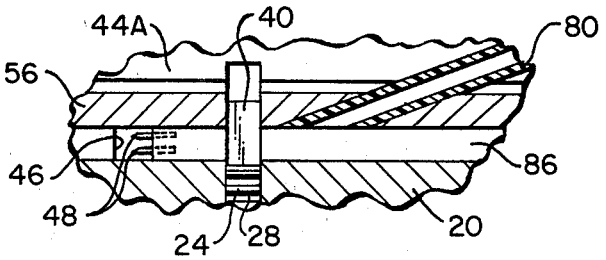
FIG. 3 is a cross-sectional side elevation view taken along the line 3—3 of FIG. 2.

DESCRIPTION OF THE PREFERRED EMBODIMENT:

With reference now to the drawing, and particularly jointly to FIGS. 1–3, apparatus in accordance with a first embodiment of the present invention is shown schematically. The disclosed apparatus includes, as major sub-systems, an immobile base, which has been indicated generally at 10, and a vertically movable feeding and coiling mechanism, indicated generally at 12. The feeding and coiling mechanism 12 includes a "mandrel" subassembly and a feed tube subassembly which is rotatable relative to the mandrel subassembly. The disclosed embodiment of the present invention also includes a pneumatic feed subassembly, indicated generally at 13, which is vertically movable with respect to the feeding and coiling subassembly 12.

The base subassembly 10 functions as a support over which a tape of heat sealable paper or plastic 14 will be fed. The heat sealable paper or plastic sheet material will be played out from a supply reel, not shown, and will be advanced through the apparatus in stepwise fashion. In the apparatus the tape 14 is supported on a platen 16 which is heated; the heat source typically being an electrical resistance heater as indicated at 18. The platen 16 will, of course, be selected so as to be commensurate in size with the coiled dimension of the product to be packaged and the apparatus will include a supporting base 20 which surrounds platen 16. Supporting base 20 includes cavities or slots, such as indicated at 22 in FIG. 1, having rotatable shearing knives 24 positioned therein.

In the disclosed embodiment, as may best be seen from FIG. 2, four orthogonally arranged shearing knives 24 are mounted in separate slots in base 20. The shearing knives 24 are mounted for rotation about shafts 26. The knives 24 are gear driven, so as to be operated simultaneously, by means of engagement of a gear sector 28 (FIG. 1), which forms a part of the knife, with a pinion gear 30. The manner in which the four knife engaging gears are simultaneously driven may best be seen from FIG. 2 and includes pairs of bevel gears 32, 34 at each of the four corners of a continuous drive train. A first of gears 32 is driven by drive shaft 36 which, in turn, is caused to be rotated in the manner to be described below.

The base member 20 has, extending upwardly therefrom, at least two guide pins 38. Pins 38 are press fit or otherwise affixed to base 20 and at all times engage the vertically movable feeding and coiling subassembly 12. As may be seen from FIG. 2, the pins 38 are outside the area occupied by the tape 14 as it is fed through the apparatus. The base member 20 is also provided with a blind hole which is engaged by locking pin 62 on the feeding and coiling subassembly 12. Pin 62, in the process of moving into engagement with the hole in base member 20, will punch through tape 14.

The vertically movable feeding and coiling subassembly 12 includes a shearing block 40 which is provided with slots 42 through which the shearing knives 24 may pass when rotated. The shearing block 40 is affixed to a tubular coil retainer 44 which is also provided, at the lower end thereof, with slots through which the knives 24 may pass. The coil retainer tube 44 is further provided with a "capture" slot 46 which may best be seen from joint consideration of FIGS. 2 and 3. A pair of "barbs" 48 extend into slot 46. The coil retainer tube 44 will typically be of two piece construction with the lower end portion 44A, which defines the capture slot, being comprised of a nonconductive material. The barbs 48, which are embedded in the lower portion 44A of the tube 44, will be metallic. Barbs 48 will be electrically connected in the energization circuit for an activator 49 which may include a pneumatic or hydraulic cylinder or a solenoid for the purpose to be described below. The inner diameter of the lower end portion 44A of retainer tube 44 defines the outer wall of a coiling annulus 86.

The feeding and coiling subassembly 12 also includes a rotatable tube 52 which is mounted coaxially with respect to the coil retainer tube 44. The rotatable tube 52 is provided, intermediate its ends, with an inner bulkhead 54. Tube 52, at its lower end, is also provided with an outwardly extending flange 56. Flange 56 defines the upper wall of the coiling annulus 86. A "coiling drum" 58 is suspended from rotatable tube 52 on a bolt 60 which engages the inner bulkhead 54 as shown. The "coiling drum" 58 forms the inner diameter of coiling annulus 86 and thus functions as a mandrel. The aforementioned locking pin 62, which engages the base member 20, extends from the "coiling drum" 58. Rotation of tube 52 relative to "coiling drum" 58 is possible since the "coiling drum" 58 is free to rotate on the head of retention bolt 60. The continuous engagement of the guide pins 38 with the shearing block 40, which is in turn affixed to the coil retainer tube 44, permits rotation of tube 52 relative to coil retainer tube 44; the latter motion being facilitated by bearings such as indicated at 64.

Vertical motion of subassembly 12 with respect to the base subassembly 10 is accomplished by means of a suitable actuator which has been schematically shown in the drawing as a hydraulic or pneumatic cylinder 66 having its piston rod 68 attached to the shearing block 40. The actuator which produces the vertical motion of subassembly 12 can, alternatively, be affixed to retainer tube 44. Vertical motion of shearing block 40 is transmitted, in the disclosed embodiment, via coil retainer tube 44 and bearings 64 to rotatable tube 52 and, via drum retention bolt 60, to the "coiling drum" 58. Rotational movement of tube 52 is produced, in the disclosed embodiment, by a chain and sprocket drive operated by motor 50; the drive including a slip clutch 70, a first sprocket 72, chain 74 and a further sprocket 76 affixed to the outside of tube 52. In the disclosed embodiment motor 50 is continuously running and chain 74 is driven via clutch 70 when a locking mechanism operated by solenoid 49 released a pin carried by the chain. Solenoid 49 will be momentarily energized by the establishment of an electrical circuit between the "barbs" 48 positioned in capture slot 46. It will be understood, however, that there are other ways in which the sensing of the receipt of a first end of the product to be coiled in slot 46, for the purpose of energizing solenoid 49, may be accomplished. Thus, by way of example, the solenoid 49 may be manually energized by an operator controlled switch. In the disclosed embodiment one complete revolution of chain 74 will be commensurate with coiling of the entire string or other product in annulus 86. The lock pin on chain 74 will be engaged by the locking mechanism operated by solenoid 49, via a camming surface thereon, to terminate rotation of tube 52 after each complete rotation of the chain.

Continuing with a discussion of the feeding and coiling subassembly 12, a conduit 80 is mounted within the rotatable tube 52 and extends generally vertically along the axis of tube 52 for a length approximately equal to the length of the product to be coiled. As shown in FIGS. 1 and 2, the product to be coiled is a music string which has been indicated at 82. String 82, in the customary manner, has a "ball" 84 at the first end thereof. In the disclosed embodiment it is the ball 84 which will bridge the barbs 48 thus completing the energizing circuit for solenoid 49. The conduit 80, as it approaches the bottom of tube 52, is guided outwardly from the axis of tube 52 so as to lead the product to be coiled and packaged into the coiling annulus 86. In one reduction to practice of the invention, the conduit 80, "coiling drum" 58 and the lower portion 44A of the coil retainer tube 44 were comprised of a suitable nonconductive material such as polytetrafluorethylene. The conduit 80 passes through the inner bulkhead 54 and then through the wall of the rotatable tube 52. Considering the disclosed embodiment of the apparatus, in a side elevation view the conduit 80 would approach the coiling annulus 86 at an acute angle, typically in the range of 20° to 30° to the plane of the coiling annulus 86. Considered in a plan view, the conduit 80 spirals outwardly from the center line of the rotating tube 52, through the wall of tube 52, and then terminates in an arc having a radius approximately equal to that of the coiling annulus 86. As may be seen from FIG. 1, at its lower end the conduit 80 penetrates the lower flange 56 on rotating tube 52. A resilient wire product delivered down conduit 80 will thus be discharged into the coiling annulus 86 along the outer wall thereof.

At the upper end of the feeding and coiling subassembly 12, a product receiving vestibule defining member 90 is mounted on the rotating tube 52. Member 90 is provided with a conically shaped opening which converges to the upper end of conduit 80. The upper end of conduit 80 is retained in the lower end of the member 90 by means of a gasket 92 which will typically be comprised of the same material as conduit 80. A first end of a product to be packaged, for example the music string 82, will be guided down the conical wall of member 90 into the upper end of conduit 80 and will typically drop down conduit 80 to the position shown in FIG. 1 where the conduit 80 is beginning to be directed outwardly. Conduit 80 will be sufficiently long relative to the product being packaged such that the upper end of the product will be below member 90 when the free movement of the product is stopped by the change in direction of conduit 80.

The pneumatic feed subassembly 13 includes a conically shaped plug 94 which is provided, on its axis, with a conduit which defines a passage 96. The plug 94 is sized and shaped so as to be received in the vestibule defining member 90 in such a manner that a substantially airtight seal will be formed at least between the lower end of plug 94 and the wall of member 90. The upper end of passage 96 is connected to a source of compressed gas which has been indicated schematically at 98. There will, of course, be a normally closed valve, for example valve 100, which may be operated to establish communication between source 98 and passage 96 at the appropriate time. Plug 94 is moved into and out of the conically shaped opening vestibule defining member 90 by means of a pneumatic or hydraulic cylinder 102. Cylinder 102 may be automatically actuated, for example by means which senses the presence of a product to be packaged in the upper end of conduit 80, or manually actuated by an operator of the apparatus. The valve 100 will be operated to the open position in response to the seating of plug 94 in member 90 and this may be accomplished by a suitable sensor associated with the piston rod of actuator 102. If rotation of tube 52, and thus of vestibule defining member 90, is to be accomplished before return of plug 94 to the position depicted in FIG. 1, a rotating seal will be established between the conduit which defines the passage 96 in plug 94 and a supply conduit from source 98 and a substantially frictionless connection will also be established so as to permit rotation of plug 94 relative to the mechanical connection to the piston rod of actuator 102.

In the operation of the disclosed embodiment of the invention, the feeding and coiling subassembly 12 will initially be raised, by means of actuator 66, above the base subassembly 10 and the pneumatic feed subassembly 13 will also be displaced from the upper end of the subassembly 12 as shown. The spacing of the feeding and coiling subassembly 12 from base subassembly 10 will be by a distance equal to the length of the locking pin 62 plus the thickness of the coiled product and any additional necessary clearance. The heat sealable paper tape or plastic 14 is indexed across the heated platen 16 a sufficient distance so as to place a length of packaging material of suitable dimensions in position to have a coiled product deposited thereon. Thereafter, the actuator 66 will be operated to lower the feeding and coiling subassembly 12 to the position shown in FIG. 1. The vertical movements of the subassembly 12 will be guided by pins 38. The product, for example the music string 82, is then introduced into the product receiving vestibule defined by member 90 and will be guided downwardly into conduit 80. The product 82 will, either under the influence of gravity or as a result of manual insertion, move down conduit 80 approximately to the position shown in FIG. 1. With the product 82 at rest in conduit 80, and its presence typically being sensed by a proximity sensor such as indicated schematically at 104, the actuator 102 will be energized and will cause the sealing cone or plug 94 to be lowered into member 90. When a seal has been established between plug 94 and member 90, the valve 100 will open and a slug of gas will be admitted to the upper end of conduit 80. Due to the relative sizing between the ball 84 at the end of music string 82 and the inner diameter of conduit 80, the ball will act as a piston and thus the pressurized gas will force the music string 82 down the spiralled lower portion of tube 80 and eject the ball 84 into the coiling annulus 86. Under the influence of the pressurized gas, the ball will move along annulus 86 until it encounters the capture slot 46. When the ball enters capture slot 46 it will be engaged by the barbs 48 and thus a circuit to energize solenoid 49 will be completed. Energization of solenoid 49 will permit motor 50 to drive tube 52 through slip clutch 70 and chain 74. Rotation of tube 52 will cause the elements affixed thereto, including conduit 80, to rotate whereby the product will be drawn into the coiling annulus 86; the elements which define the inner, outer and bottom walls of annulus 86 being stationary. When a sufficient number of revolutions to extract the entire music string 82 or other product from conduit 80 have been completed, the rotation will be terminated in the manner described above. The rotation of tube 52 will be stopped at a point where the slots in flange 56 are in registration with the slots 42 in the shearing block 40.

The cessation of rotation of tube 52 may be sensed and employed as a command signal for a knife actuator which delivers rotational motion to shaft 36 whereby all four shearing knives 24 will be rotated about their respective axes simultaneously. The knives 24 will shear locking tabs out of the heat sealable tape 14 and these tabs are folded by the knives 24 about the coiled product in annulus 86 and into contact with the upper surface of the tape which is radially disposed toward the center of the annulus and over the heated platen 16. Contact of the sheared tabs, as indicated at 106 in FIG. 4, with the upper surface of the tape produces instant adhesion of the tabs to the base material thereby locking the coiled product in the coiled position and to the tape. The knives 24 may, of course, be energized manually by observing the stopping of chain 74.

After the tabs 106 have been sheared from tape 14 and wrapped over the coiled product, the knives 24 are rotated back to their initial position within the base 20 and the subassemblies 12 and 13 are both raised to their initial positions. The upward movement of the feeding and coiling subassembly 12 will raise locking pin 62 so that it clears the coiled products. The upward movement of subassembly 12 also releases the ball 84 at the end of the music string 82 from the capture slot 46 since the "barbs" 48 are slightly angled downwardly as shown in FIG. 3. The tape 14 is thereafter indexed so as to place a fresh, unsheared area of packaging material in position to receive the next product unit.

Figure 4:
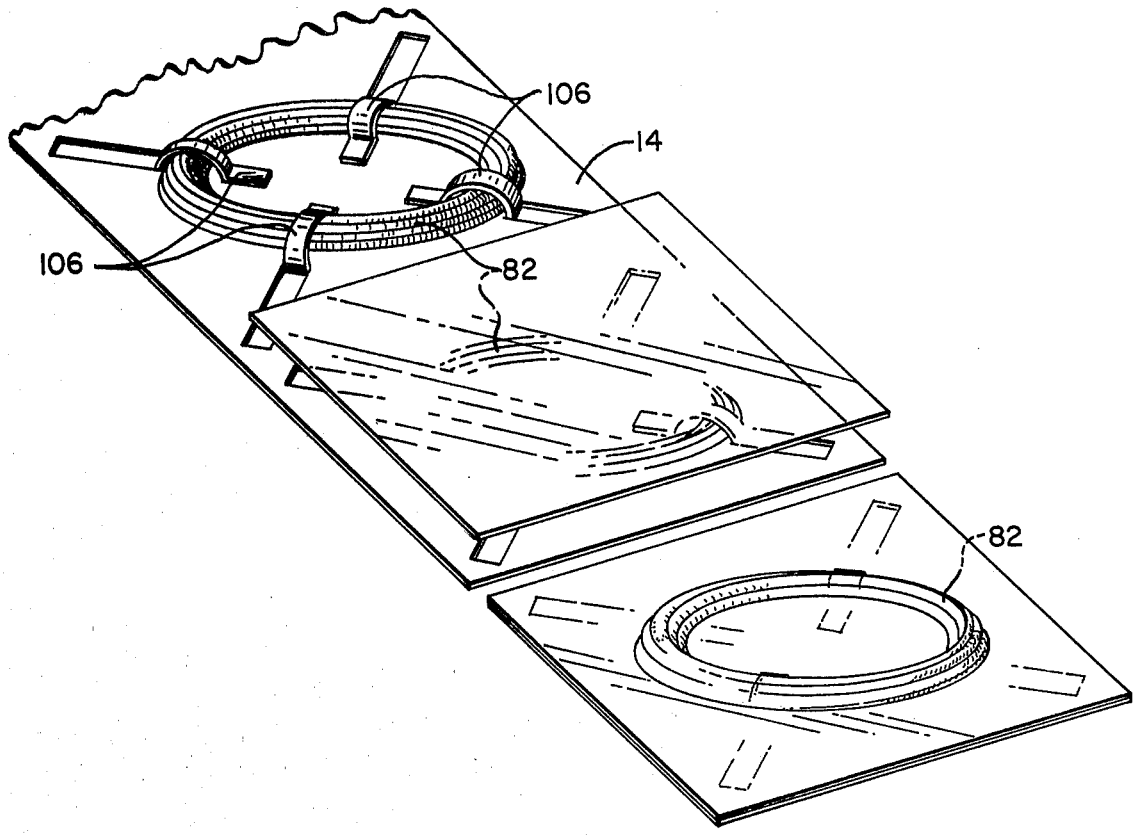
FIG. 4 is a perspective view depicting the pre-packaged coiled product as it exits from the apparatus of FIGS. 1–3, FIG. 4 also showing further packaging of the product.

As represented in FIG. 4, the coiled product captured on tape 14 may subsequently be completely encapsulated by draping heat sealable plastic or paper over the top and bottom sides of tape 14. If such complete encapsulation is desired, typically a continuous "belt" of packaged product will be maintained. Alternatively, each of the coiled products may be sheared from the tape and placed in individual packages such as, for example, heat sealable bags.

While a preferred embodiment has been shown and described, various modifications and substitutions may be made thereto without departing from the spirit and scope of the invention. Accordingly, it will be understood that the present invention has been described by way of illustration and not limitation.

What is claimed is:

1. Apparatus for use in the packaging of flexible filamentary members comprising:
   - means defining an open-sided coiling annulus;
   - means for positioning a sheet of packaging material in registration with said coiling annulus;
   - means for causing relative movement in a first direction between said packaging material positioning means and said annulus defining means whereby an open side of said annulus is spanned by the packaging material;
   - means for delivering a member to be packaged into said coiling annulus;
   - means for causing relative rotational movement between said delivering means and said annulus defining means to cause coiling of the filamentary member in said coiling annulus; and
   - means for shearing at least a first tab from said sheet of packaging material and folding said tab over the coiled member to retain the coiled form of the member on the sheet of packaging material.

2. The apparatus of claim 1 wherein said packaging material positioning means includes a heated platen and wherein the packaging material will adhere to itself when heated.

3. The apparatus of claim 1 wherein said annulus defining means includes means defining spaced inner and outer cylindrical walls and wherein said outer wall is provided with means for engaging a first end of the member whereby relative rotation between said delivering means and said annulus defining means subsequent to engagement of a first end of the member by said engaging means will result in the member being drawn from said delivering means into the coiling annulus.

4. The apparatus of claim 3 wherein said packaging material positioning means includes a heated platen and wherein the packaging material will adhere to itself when heated.

5. The apparatus of claim 1 wherein the filamentary member to be packaged has an enlarged first end portion and wherein said feed means includes:
   - tube means, said tube means having a length in excess of the length of the member to be packaged, said tube means including a feed conduit having a first product receiving end and a second end which communicates with the coiling annulus, the cross-sectional area of the inside of said tube means feed conduit not substantially exceeding the cross-sectional area of the enlarged end portion of the member to be packaged; and
   - means for coupling a source of pressurized gas to the product receiving end of said tube means feed conduit whereby the enlarged end portion of the member to be packaged will function as a piston to pull the flexible member through said conduit until the enlarged end portion enters the coiling annulus.

6. The apparatus of claim 5 wherein said annulus defining means includes:
   - means defining spaced inner and outer cylindrical walls; and
   - product engaging means carried by said outer cylindrical wall, said engaging means capturing a first enlarged end of a member to be packaged whereby relative rotation between said delivering means and annulus defining means will result in the member to be packaged being drawn from said delivering means into the coiling annulus.

7. The apparatus of claim 6 wherein said engaging means comprises:
   - a capture slot in said annulus defining means outer cylindrical wall; and
   - prong means extending into said capture slot.

8. The apparatus of claim 5 wherein said packaging material positioning means includes a heated platen and wherein the packaging material will adhere to itself when heated.

9. The apparatus of claim 7 wherein said packaging material positioning means includes a heated platen and wherein the packaging material will adhere to itself when heated.

10. The apparatus of claim 9 wherein the flexible members are music strings and wherein said shearing means comprises:
   - a plurality of rotatable knives; and
   - means for simultaneously operating said knives.

11. The apparatus of claim 10 wherein said tube means feed conduit follows a non-linear path and a music string will freely slide along said conduit for a distance at least equal to its length prior to the application of gas pressure to the conduit.

12. The apparatus of claim 11 wherein said feed means further includes:
   - lower flange means, said lower flange means being penetrated by said tube means feed conduit, said lower flange means defining the side of the coiling annulus disposed oppositely to said heated platen.

13. The apparatus of claim 12 further comprising:
   - guide means for preventing relative rotation between said annulus defining means and said packaging material positioning means.

14. The apparatus of claim 13 wherein said annulus defining means and said packaging material positioning means are provided with aligned slots and wherein said knives are mounted on said packaging material positioning means for radial movement with respect to the axis of the coiling annulus in said aligned slots.

15. A method for packaging filamentary members comprising the steps of:
   - delivering a first end of an uncoiled member to a point juxtapositioned to a sheet of heat sealable packaging material;
   - coiling the member on a first surface of the sheet of heat sealable material;
   - shearing tabs from the sheet of heat sealable material; and
   - folding the sheared tabs over the coiled member to retain the member in coiled form on the sheet, the folded tabs contacting and adhering to the first surface of the sheet.

16. The method of claim 15 wherein the step of coiling includes:
   - forming a coiling annulus, the sheet of heat sealable material defining a first side of said annulus; and
   - causing relative rotation between the annulus and the uncoiled member to thereby draw the member into the annulus.

17. The method of claim 16 wherein the step of delivering the uncoiled member comprises:
   - loading the member into a conduit;

feeding the member through the conduit until a first end thereof enters the annulus; and capturing the first end of the member in the annulus.

18. The method of claim 17 wherein the step of feeding the member through the conduit includes:

forcing the member through the conduit by means of pneumatic pressure.

19. The method of claim 18 wherein the flexible members are music strings having enlarged portions at first ends thereof and wherein the step of loading includes:

inserting the enlarged end portion of a string into a conduit, said enlarged end portion functioning as a piston upon the subsequent application of pneumatic pressure.

20. The method of claim 19 wherein the step of forming a coiling annulus includes:

causing relative movement between the sheet of heat sealable material and an annulus defining member in a first direction; and wherein said method further comprises:

causing relative movement between the sheet of heat sealable material and the annulus defining member in a second direction to permit further handling of the coiled product subsequent to the step of folding the tabs.

21. Apparatus for use in the coiling of flexible filamentary members comprising:

means defining the outer side wall of an annular chamber; p1 means defining a first end wall of said annular chamber, said first end wall being spaced from said outer wall;

means defining an inner side wall of said annular chamber, said inner wall defining means being supported from said first end wall defining means and being rotatable with respect thereto;

means defining a second end wall of said annular chamber, said second end wall being spaced from said inner and outer wall defining means, said second end wall defining means being stationary;

means for delivering a flexible filamentary member into said annular chamber, said delivering means extending through said first end wall defining means;

grip means positioned within said chamber at a position spaced from the end walls thereof for temporarily capturing the leading end of a filamentary member fed into the chamber by said delivering means; and means for causing relative rotation between said first end wall defining means and both of said side wall defining means, a filamentary member having its first end captured by said grip means being drawn into the chamber and formed into a coil during said relative rotation.

22. The apparatus of claim 21 wherein said outer wall defining means is supported from said first end wall defining means by bearing means and wherein said rotation causing means simultaneously imparts rotation to said first end wall defining means and said delivering means.

23. The apparatus of claim 22 wherein said inner wall defining means is mounted for free rotation relative to said first end wall defining means and wherein said apparatus further comprises:

means for preventing rotation of said inner wall defining means during rotation of said first end wall defining means, said rotation preventing means establishing a fixed positional relationship between said inner wall defining means and said stationary second end wall defining means.

24. The apparatus of claim 23 further comprising:

means for causing simultaneous movement of said inner and outer wall defining means and said first end wall defining means relative to said second end wall defining means, said means for causing relative movement with respect to said second end wall defining means selectively engaging and disengaging said rotation preventing means.

25. The apparatus of claim 24 further comprising:

means for positioning a sheet of packaging material on said second end wall defining means in registration with said annular chamber; and means for shearing at least first tab from said sheet of packaging material and folding said tab over the coiled member to retain the coiled form of the member.

26. The apparatus of claim 25 wherein said means for capturing a first end of the member comprises:

a capture slot in the wall defined by said outer wall defining means; and barb means extending into said capture slot.

* * * * *